US005531574A

United States Patent [19]

Honma

[11] Patent Number: 5,531,574

[45] Date of Patent: Jul. 2, 1996

[54] CLOSED-TYPE COMPRESSOR

[75] Inventor: Hisanori Honma, Yokohama, Japan

[73] Assignee: Kabushiki Kaisha Toshiba, Kawasaki, Japan

[21] Appl. No.: 301,025

[22] Filed: Sep. 6, 1994

[30] Foreign Application Priority Data

Feb. 28, 1994 [JP] Japan ..... 6-030468

[51] Int. Cl.[6] ..... F04B 35/04

[52] U.S. Cl. ..... 417/415; 417/DIG. 1; 92/170.1; 92/223

[58] Field of Search ..... 417/415, 902, 417/DIG. 1; 92/170.1, 223

[56] References Cited

U.S. PATENT DOCUMENTS

| | | | |
|---|---|---|---|
| 2,996,240 | 8/1961 | Stöcklein et al. | 417/902 |
| 4,848,213 | 7/1989 | Wood et al. | 92/172 |
| 5,199,859 | 4/1993 | Kitaichi | 417/410 |
| 5,273,410 | 12/1993 | Kitaichi et al. | 92/223 |
| 5,378,123 | 1/1995 | Scuderi et al. | 417/415 |
| 5,408,839 | 4/1995 | Kitaichi et al. | 418/179 |

FOREIGN PATENT DOCUMENTS 4-287876 10/1992 Japan .

*Primary Examiner*—Charles Freay
*Attorney, Agent, or Firm*—Foley & Lardner

[57] ABSTRACT

A closed-type compressor includes a closed casing accommodating an electric motor from which a rotational shaft extends and a compressing machine to be operated by the motor and the compressing machine is of a reciprocating-type and provided with sliding portions. A hydrofluorocarbon (HFC) refrigerant is used as a compressor refrigerant, and a refrigerator oil consisting essentially of ester is used as a lubricating oil. The sliding portions of the compressing machine each is formed of two members one of which is made of cast iron subjected to an insoluble film forming process using manganese phosphate and another one of which is made of carbon steel.

14 Claims, 4 Drawing Sheets

CLOSED-TYPE COMPRESSOR

BACKGROUND OF THE INVENTION

1. Field of the Invention

The present invention relates to a closed-type compressor to be included in a refrigerating cycle of a refrigerator or the like and more particularly to a reciprocating and closed-type compressor having a compressing machine provided with sliding portions improved in a wear resistance.

2. Description of the Prior Art

A refrigerator or cold storage, a refrigerating unit such as a refrigerating showcase and an air conditioner for cooling and heating a room is incorporated with a refrigerating cycle therein. The refrigerating cycle includes a compressor which is a closed-type compressing machine driven by an electric motor. The closed-type compressor compresses a compressor refrigerant to raise a temperature and a pressure of the compressor refrigerant which is then discharged into the refrigerating cycle.

A conventional closed-type compressor uses, as a compressor refrigerant, CFC (chlorofluorocarbon) 12 (hereinafter called "R12") or HCFC (hydrochlorofluorocarbon) 22 (hereinafter called "R22"), and as a lubricating oil, a naphthene type or paraffin type mineral oil is used. The compressor refrigerants and the lubricating oils are selected in consideration of a temperature, at which the compressor is used, a material of a sliding member, a capacity of a cylinder and so forth.

However, the refrigerant R12 is chemically stable in the atmosphere and there is, accordingly, a risk of destroying the ozone layer. Therefore, it is a specific fleon which must be regulated. On the other hand, the refrigerant R22 is a designated fleon because it can easily be decomposed in the atmosphere and its force for destroying the ozone layer is limited. However, it somewhat destroys the ozone layer and, therefore, a compressor refrigerant in place of the specific fleon and the designated fleon has been desired.

Recently, as an alternative fleon for use in place of the specific fleon and the designated fleon, refrigerant R134a, which is a HFC refrigerant that does not destroy the ozone layer, has been developed. The refrigerant R134a has characteristics as the refrigerant like R22, which is a HCC refrigerant.

If refrigerant R134a, which is the HFC refrigerant, is used as the compressor refrigerant to operate the closed-type compressor, the compatibility with the HFC refrigerant is unsatisfactory in a case where a mineral oil is used as the lubricating oil. Therefore, an ester oil has been investigated to be used as a lubricating oil that exhibits excellent compatibility with the refrigerant R134a.

If the refrigerant R134a, which is the HFC refrigerant, is used as the compressor refrigerant for the closed-type compressor and the ester oil exhibiting excellent compatibility with the refrigerant R134a is used, sliding portions or members of the compressing machine accommodated in a closed casing are worn excessively. Therefore, it is desired for the sliding portions to have excellent wear resistance property. The term "sliding portion" used herein means a portion at which two members of the compressing machine are slid with each other.

The conventional closed-type compressor of a type employing the reciprocating-type compressing machine has an arrangement that the sliding portions are made of cast iron or carbon steel, and the sliding portions, on which relatively high load and heavy duty act, are subjected to surface treatment such as a nitriding treatment to improve the surface hardness. Furthermore, the cast-iron cylinder for sliding a piston is subjected to precise finishing work such as honing to cause the sliding to be performed smoothly.

Even if the foregoing measurements are taken, the use of the refrigerant R134a containing no chlorine as the compressor refrigerant and the use of the ester-type oil as the lubricating oil for the closed-type compressor cause excessive wear and damage to occur in the sliding portions of the compressing machine, in particular, the sliding portions between the cylinder and the piston and between a small-diameter end ball portion of the connection rod and a piston spherical seat portion. Therefore, there arises a problem in maintaining the performance of the compressor and the reliability thereof.

SUMMARY OF THE INVENTION

An object of the present invention is to substantially eliminate defects or drawbacks encountered in the prior art and to provide a closed-type compressor capable of effectively preventing wear and damage of the sliding portions of the compressing machine thereof and therefore maintaining the performance of the compressor thereof for a long time exhibiting excellent reliability.

Another object of the present invention is to provide a closed-type compressor capable of improving wear resistance and damage resistance of the sliding portions of the compressing machine even if a HFC refrigerant such as refrigerant R134a involving an ozone destructive coefficient of zero is used as a compressor refrigerant and if a refrigerator oil containing an ester oil is used as a lubricating oil.

Another object of the present invention is to provide a closed-type compressor in which a lubricating film is formed on the sliding portions of the compressing machine to prevent metal contact for the purpose of effectively preventing burning, galling, wear and damage.

Another object of the present invention is to provide a closed-type compressor in which a cylinder is disposed in an offset manner to lower the surface pressure acting on the sliding portions of the cylinder of a compressing machine in order to smoothly slide the piston.

These and other objects can be achieved according to the present invention by providing, in one aspect, a closed-type compressor which comprises a closed casing accommodating an electric motor from which a rotation shaft extends and a compressing machine to be operated by the motor, the compressing machine being provided with a sliding portion, wherein a hydrofluorocarbon (HFC) refrigerant is used as a compressor refrigerant, a refrigerator oil containing an ester oil is used as a lubricating oil and the sliding portion of the compressing machine is formed of two members one of which is made of cast iron subjected to an insoluble film forming treatment using manganese phosphate and another one of which is made of carbon steel.

The compressing machine is of a reciprocating-type provided with a piston-cylinder assembly and one of the members constituting the sliding portion is a cylinder member of the piston-cylinder assembly and the other one of the members constituting the sliding portion is a piston member of the piston-cylinder assembly.

In another aspect, there is provided a closed-type compressor which comprises a closed casing accommodating an electric motor from which a rotation shaft extends and a compressing machine to be operated by the motor, the compressing machine being provided with a sliding portion, wherein a hydrofluorocarbon (HFC) refrigerant is used as a compressor refrigerant, a refrigerator oil containing an ester-type oil is used as a lubricating oil and the sliding portion of the compressing machine is formed of two members one of which is made of cast iron subjected to a nitriding treatment and to an insoluble film forming treatment using manganese phosphate and the other one of which is made of a carbon steel not subjected to any treatment.

The compressing machine is of a reciprocating-type compressing machine provided with a piston-cylinder assembly, one of the members constituting the sliding portion is a piston spherical seat member of the piston-cylinder assembly and the other one of the members constituting the sliding portion is one end ball portion of a connection rod operatively connected to the rotation shaft, the one end ball portion having a diameter smaller than that of another end portion of the connection rod.

In a further aspect, there is provided a closed-type compressor which comprises a closed casing accommodating an electric motor from which a rotation shaft extends and a compressing machine to be operated by the motor, the compressing machine being provided with a sliding portion, wherein a hydrofluorocarbon (HFC) refrigerant is used as a compressor refrigerant, a refrigerator oil containing an ester oil is used as a lubricating oil and wherein the compressing machine is of a reciprocating-type provided with a piston-cylinder assembly in which the sliding portion of the compressing machine is formed of two members one of which is a cylinder member of the piston-cylinder assembly made of cast iron subjected to an insoluble film forming treatment using manganese phosphate and the other one of which is a piston member of the piston-cylinder assembly made of carbon steel, the piston member including a piston spherical seat portion subjected to a nitriding treatment and then subjected to an insoluble film forming treatment using manganese phosphate, the piston spherical seat portion being engaged with a connection rod operatively connected to the rotation shaft, the connection rod has one end ball portion having a diameter smaller than the other one end thereof and made of a carbon steel not subjected to any treatment.

In any one of the above aspects, the cylinder member of the piston-cylinder assembly is disposed in an offset manner such that an axial line of the cylinder member passes through a position deviated from an axial line of the rotation shaft of the motor transmitting a rotational torque from the motor.

It is also preferred to utilize the refrigerant R134a as the HFC refrigerant.

As described above, according to the present invention, the closed-type compressor uses the HFC refrigerant (the HFC refrigerant is solely used or a mixed type HFC refrigerant is used) as the compressor refrigerant. Therefore, the refrigerant involves substantially zero ozone destructive coefficient, thus being moderate for the earth environment. Furthermore, the use of the refrigerator oil containing the ester oil as the lubricating oil results in excellent heat resistance and satisfactory compatibility with the HFC refrigerant, preferably R134a.

Further, the cast iron of the manganese phosphate type and subjected to the insoluble film forming treatment is employed to form one member of the sliding portion of the compressing machine and the carbon steel is used to form another member so that the insoluble lubricating film is formed on at least one of the members constituting the sliding portion to prevent metal contact. Therefore, wear and damage of the sliding portion can effectively be prevented, thus enabling the performance of the compressor to be maintained for a long time and the reliability thereof to be improved.

Even if the HFC refrigerant containing no chlorine is used as the compressor refrigerant and the refrigerator oil containing the ester-type oil is used as the lubricating oil, the insoluble film forming process using the manganese phosphate or the like enables a lubricating film to be formed on the surfaces of the sliding portions. Therefore, burning, galling and wear can effectively be prevented so that the wear resistance and the damage resistance are improved.

The insoluble film formed on the sliding portions is able to eliminate appearance of projections and pits in the surface finished by machining. Thus, the initial conformability of the sliding members can be improved.

Furthermore, the cast-iron cylinder, which is one of the sliding members of the sliding portion of the reciprocating-type compressing machine, is subjected to the insoluble film forming treatment using the manganese phosphate. Therefore, the insoluble lubricating film is formed on the sliding surfaces of the cylinder and the piston. Thus, the metal contact between the cylinder and the piston can be prevented so that the sliding of the piston can be smoothed. As a result, galling, damage and wear of the piston can effectively be prevented.

Since the cylinder is so disposed in the offset manner that the axial line of the cylinder of the reciprocating-type compressing machine passes through a position deviated from the axial line of the rotation shaft for transmitting the rotational torque from the motor. Therefore, the surface pressure acting on the sliding portions of the cylinder can be lowered to smoothly slide the piston.

Furthermore, one of the members constituting the sliding portion of the compressing machine is subjected to the nitriding treatment and the carbon steel subjected to the insoluble film forming treatment using the manganese phosphate is used. Therefore, the surface hardness of the sliding surface of the sliding portion can be improved by the surface treatment by the nitriding treatment. Then the insoluble film forming treatment is performed to form the lubricating film. Therefore, a sliding portion, on which a relatively high load or heavy duty acts, can be adequately realized. In this case, the lubricating film is formed by subjecting the sliding portion to the insoluble film forming process to prevent metal contact and improve the wear resistance and damage resistance.

The piston spherical seat portion, which is one member of the sliding portion of the reciprocating-type compressing machine and which is made of carbon steel, is subjected to the nitriding treatment. Therefore, the sliding portion between the piston and the connection rod, on which a relatively high load and heavy duty act, can be lubricated smoothly because the metal contact can be prevented.

Still furthermore, since the cast-iron cylinder, which is one of the members of the sliding portion of the reciprocating-type compressing machine is subjected to the insoluble film forming treatment using manganese phosphate, the lubricating film can be formed on the sliding surface. Therefore, the metal contact can be improved to improve the wear resistance and the damage resistance. Since the spherical seat portion of the piston is subjected to the nitriding treatment and then the insoluble film forming treatment using manganese phosphate is performed, the hardness of the sliding surfaces of the sliding portions between the piston and the connection rod, on which relatively high load and heavy duty act, can be improved. Since the lubricating film is formed, the lubricating between the piston and the connection rod can be performed smoothly because the metal contact can be prevented. Therefore, the overall body of the sliding portion of the reciprocating-type compressing machine can smoothly be lubricated. Thus, the wear resistance and the damage resistance can be improved.

Other and further objects, features and advantages of the present invention will be made more clear from the following description with reference to the accompanying drawings.

DESCRIPTION OF THE PREFERRED EMBODIMENT

An embodiment of a closed-type compressor according to the present invention will now be described with reference to the accompanying drawings.

Figure 1:
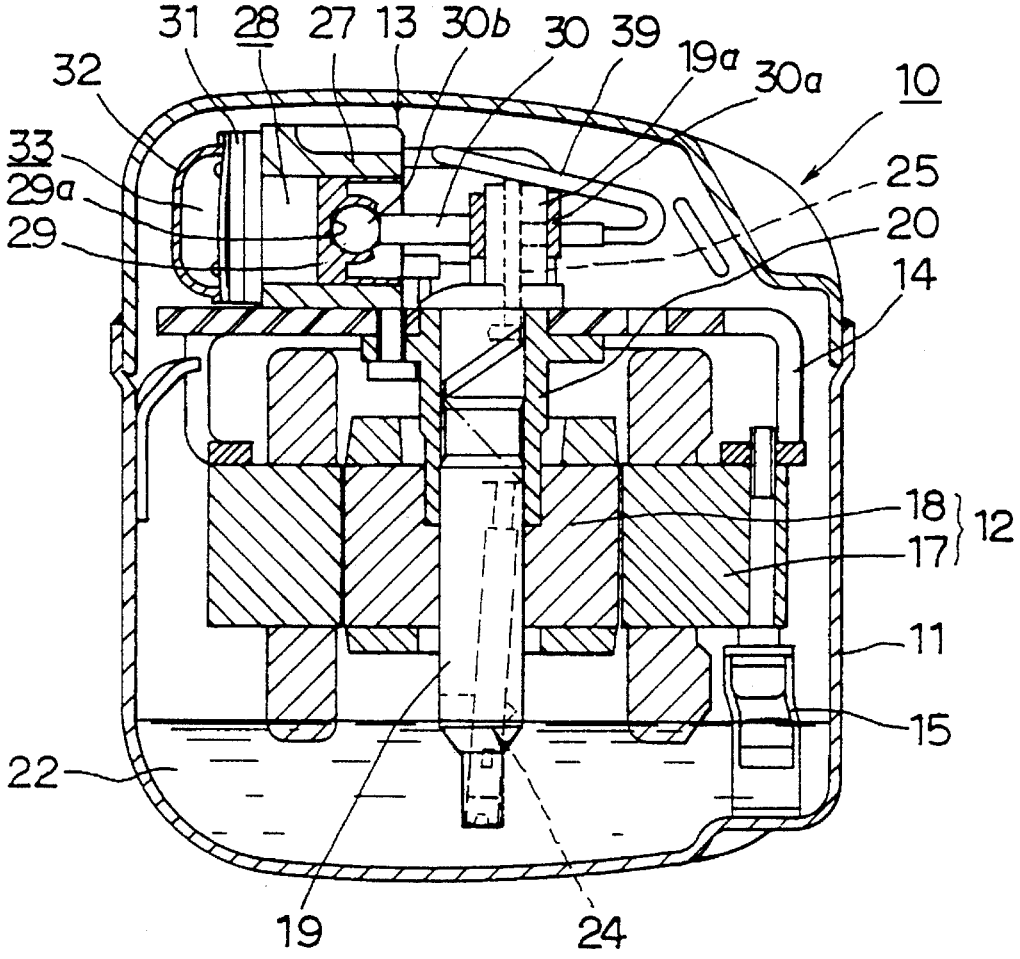
FIG. 1 is a vertical sectional view showing an embodiment of a closed-type compressor according to the present invention.
Figure 2:
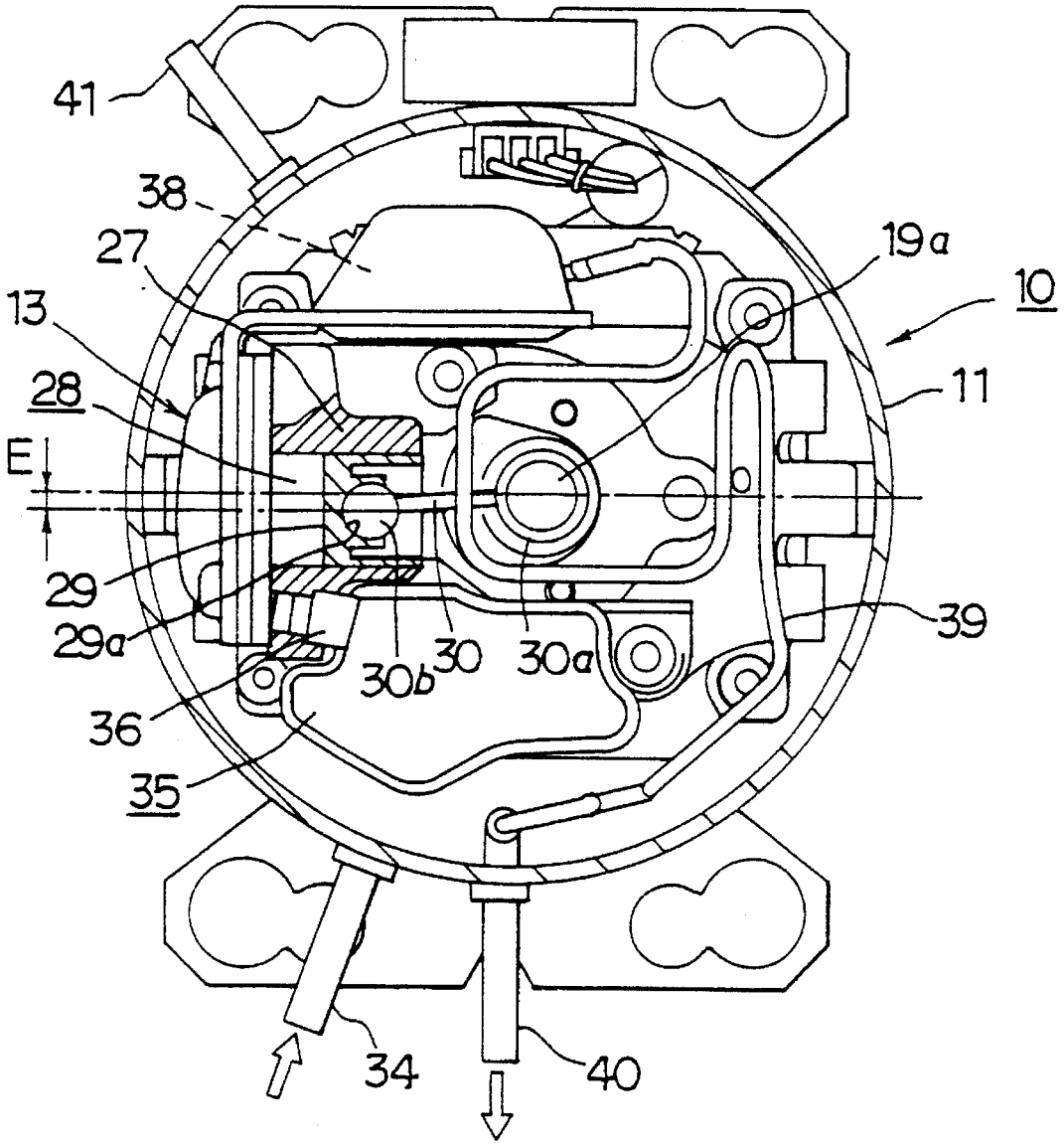
FIG. 2 is a horizontal sectional view showing the closed-type compressor shown in FIG. 1.

FIGS. 1 and 2 illustrate a reciprocating, vertical and closed-type compressor to be included in a refrigerating cycle of a refrigerator or the like. The closed-type compressor 10 has a motor 12 accommodated in a lower portion in a closed casing 11. On the other hand, a reciprocating type compressing machine 13 to be operated by the motor 12 is accommodated in the upper portion in the closed casing 11. The motor 12 and the compressing machine 13 are secured to a fixed frame 14, and thus, they are integrally assembled so as to be elastically supported in a floated state in the closed casing 11 by a plurality of support springs 15. A plurality of, for example, three, support springs 15 are disposed along the circumferential direction in the closed casing 11 at adequate intervals.

The motor 12 comprises a stator 17 formed by stacked plate-like stator cores and a rotor 18 rotatively accommodated in the stator 17. A rotation shaft 19 is received by the rotor 18 and the rotation shaft 19 is rotatively supported by a bearing 20 secured to the fixed frame 14 and formed into a slide bearing structure. The upper portion, as viewed, of the rotation shaft 19 upwards project over the bearing 20 so that a crank portion **19*a*** is formed in the projecting portion, thus forming a crank shaft.

The lower portion of the rotation shaft 19 extends downwards over the rotor 18 such that the leading portion of the rotation shaft 19 is immersed in a lubricating oil 22 reserved in the closed casing 11. In the rotation shaft 19, an oil pump 24 is disposed to act as a pump when the rotation shaft 19 is rotated so as to supply the lubricating oil 22 to the sliding portions of the reciprocating-type compressing machine 13 through an oil passage 25 in the rotation shaft 19. Thus, each sliding portion is lubricated with the oil.

As the lubricating oil 22 for lubricating the sliding portions of the compressing machine 13, an ester oil is used as a synthesized oil exhibiting excellent heat resistance. In place of the ester oil, an alkylbenzene-type oil or a mixed oil containing ester oil and the alkylbenzene-type oil may be used as the lubricating oil 22. Alternatively, a refrigerator oil containing the ester oil as the base oil thereof or the main component thereof may be used.

The reciprocating-type compressing machine 13 to be operated by the motor 12 through the rotation shaft 19 comprises a piston-cylinder assembly including cylinder 27 disposed on the fixed frame 14 and a piston 29 disposed slidably in a cylinder chamber 28 formed by a cylinder bore of the cylinder 27, a connection rod 30 serving for connecting the piston 29 to the crank portion **19*a* of the rotation shaft 19, a head plate 31 disposed in the head portion of the cylinder 27 and having a suction valve and a discharge valve, not shown, and a cylinder cover 32 for covering, from outside, the head plate 31. The cylinder cover 32 includes a suction room 33 and a discharge chamber, not shown, so that, as shown in FIG. 2, the refrigerant sucked into the closed casing 11 through a suction pipe 34 is introduced into the suction room 33 from a suction chamber 35 through a suction passage 36. The refrigerant is then guided from the suction room 33 to the cylinder chamber 28. The closed-type compressor 10 is a compressor of a type having the low-pressure closed casing 11**.

A discharge muffler 38 connected to the discharge chamber is formed integrally with the cylinder cover 32 so that the compressor refrigerant discharged into the discharge chamber is discharged from the discharge muffler 38 to a discharge pipe 40 through a discharge pipe 39. A sealing pipe 41 for sealing the compressor refrigerant into the closed-type compressor 10 is also mounted to the casing 11.

As the compressor refrigerant, 1,1,1,2-tetrafluoroethane (hereinafter called "refrigerant R134a") is used which is an HFC refrigerant being stable in the atmosphere, which does not destroy the ozone layer and which is moderate for the environment of the earth.

As the compressor refrigerant, another HFC refrigerant may be used in place of the refrigerant R134a.

The other HFC refrigerant is exemplified by difluoromethane (R32), pentafluoroethane (R125), 1,1,2,2-tetrafluoroethane (R134), 1,1,2-trifluoroethane (R143), 1,1,1-trifluoroethane (R143a), 1,1-difluoroethane (R152a) and monofluoroethane (R161), each of which, as a single refrigerant, exhibits a discharge pressure higher than that of HCFC22 (R22).

Among these refrigerants, it is preferable to employ R134, R134a, R143 or R143a as an alternative refrigerant because they involve a boiling point near that of the conventional CFC12 (R12).

The HFC refrigerant may be a mixture prepared by mixing two or more types of the HFC refrigerants as well as using as a single refrigerant. The mixed HFC refrigerant is exemplified by a mixed refrigerant of R125/R143a/R134a, a mixed refrigerant of R32/R134a, a mixed refrigerant of R32/R125, a mixed refrigerant of R32/R125/R134a and a mixed refrigerant of R125/R143a.

The operation of the closed-type compressor 10 will be described hereunder.

When an electric power is supplied to the motor 12 of the closed-type compressor 10, the rotor 18 of the motor 12 starts to rotate and the rotation shaft 19 is rotated integrally with the rotor 18. The rotational torque of the motor 12 is transmitted to the piston 29 through the rotation shaft 19, the crank portion 19*a* and the connection rod 30. Thus, the piston 29 is reciprocated in the cylinder 27.

When the piston 29 is reciprocated, the compressor refrigerant is sucked from the suction room 33 into the cylinder chamber 28 so that the refrigerant is compressed. The compressor refrigerant of the temperature and the pressure having been raised through the compression is discharged into the discharge chamber. The noise is eliminated in the discharge muffler 38, and then, the refrigerant is allowed to pass through the discharge pipe 39 so as to be discharged into the refrigerating cycle through the discharge pipe 40.

The compressor refrigerant from the refrigerating cycle is sucked into the closed casing 11, and then introduced into the suction room 33 to prepare for the next operation for compressing the refrigerant.

The sliding portions of the reciprocating-type compressing machine 13 are formed by portions each or respectively between (1) the rotation shaft 19 and the bearing 20, (2) the crank portion 19*a* of the rotation shaft 19 and a large-diameter end 30*a* of the connection rod 30, (3) a small-diameter end ball portion 30*b* of the connection rod 30 and a spherical seat portion 29*a* of the piston 29 and (4) the cylinder 27 and the piston 29. The small-diameter end ball portion 30*b* is caulked with the spherical seat portion 29*a* of the piston 29 so as to be connected and joined together.

The sliding portion between the rotation shaft 19 and the bearing 20 and the sliding portion, i.e. the connected and joint portion, between the crank portion 19*a* of the rotation shaft 19 and the large-diameter end 30*a* of the connection rod 30 are sufficiently supplied with the lubricating oil 22 when the rotation shaft 19 is rotated due to the pumping operation of the centrifugal oil pump 24 provided for the rotation shaft 19. The sliding portions serve as passages for the lubricating oil 22 and the lubricating oil film is maintained due to the rotational motion. Therefore, the sliding portions can stably and smoothly be lubricated.

On the other hand, the small-diameter end ball portion 30*b* of the connection rod 30 is swung with respect to the spherical seat portion 29*a* which reciprocates when the rotation shaft 19 is rotated. The small-diameter end ball portion 30*b* cannot easily be supplied with the lubricating oil 22 because of the structure of the small-diameter end ball portion 30*b*. The cylinder 27 and the piston 29 are subjected to the reciprocating motion and the head portion of the cylinder 27 is heated, thus causing clearance change and oil shortage to take place easily. The portions are subjected to severe sliding conditions.

On the other hand, the cylinder 27 and the rotation shaft, hence, the crank shaft, 19 constituting the reciprocating-type compressing machine 13 are made of cast iron, while the piston 29, the bearing 20 and the connection rod 30 which slide in the cylinder 27 are each made of carbon steel.

One of the members or portions constituting the sliding portion which is subjected to the severe sliding conditions, for example, the surface of the bore in the cylinder 27, is subjected to a treatment for forming a manganese phosphate film serving as a film formed by chemical reactions. Although the piston 29 sliding in the cylinder 27 is made of carbon steel which is not subjected to the film forming treatment, the surface of the piston 29 may be subjected to the manganese phosphate film forming treatment. An insoluble film made of porous crystal material is formed on the surface of the cylinder bore by effecting the manganese phosphate film forming treatment to the surface. The thus formed film absorbs and maintains the lubricating oil 22 to satisfactorily maintain the performance.

The relatively heavy loads and heavy duty concentrically act on the connected and sliding portions between the piston 29 and the connection rod 30. Therefore, the surface of the spherical seat portion 29*a* of the piston 29 made of the carbon steel is subjected to a nitriding treatment to harden the surface. Furthermore, the spherical seat portion 29*a* subjected to the nitriding treatment is further subjected to the manganese phosphate film forming treatment so as to form an insoluble film for the purpose of improving the lubricating performance. The small-diameter end ball portion 30*b* of the connection rod 30 which is the other one of the members or portions constituting the sliding portion is made of carbon steel which is not subjected to the film forming process. The manganese phosphate film forming treatment performed after the nitriding treatment may be applied to the surface of the small-diameter end ball portion 30*b* of the connection rod 30 to be engaged to the spherical seat portion 29*a* as well as the spherical seat portion 29*a*.

In the conventional closed-type compressor using the refrigerant CFC12 as the compressor refrigerant, chlorine contained in the refrigerant CFC12 has an effect of assisting the operation for lubricating the sliding portions. However, the refrigerant R134a, which is the HFC refrigerant involving an ozone layer destructive coefficient of zero, does not contain chlorine. Therefore, the effect of improving the lubricating performance caused from the chlorine cannot be expected. However, the closed-type compressor 10 according to this embodiment in which at least one of the members constituting the sliding portion of the reciprocating-type compressing machine 12, which are subjected to the severe sliding conditions, is subjected to the manganese phosphate film forming treatment. Thus, the film forms the porous members made of the insoluble film that is able to absorb and maintain the lubricating oil 22. Therefore, a satisfactory lubricating operation can be performed.

Then, an example of the relationship between the time, in which the sliding portion of the reciprocating-type compressing machine 12 is operated, and the quantity of abrasion will be described hereunder in a case where the refrigerant R134a, which is a HFC refrigerant, is used as the compressor refrigerant and the ester oil exhibiting excellent compatibility with the HFC refrigerant is used as the lubricating oil.

Figure 3:
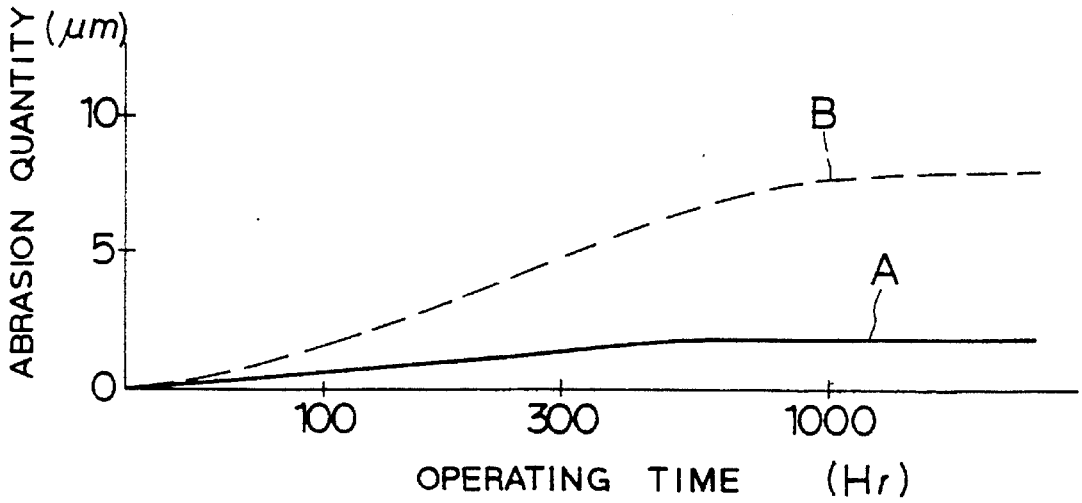
FIG. 3 is a graph showing change with time in the quantity of wear of a piston spherical seat portion of a reciprocating-type compressing machine of the closed-type compressor of FIG. 1.

FIG. 3 shows change in the quantity of abrasion of the spherical seat portion 29*a* taken place as the time passes in a unit test of the closed-type compressor 10. The unit test, effected to the closed-type compressor 10, is a test performed such that the closed-type compressor 10, the discharge and suction pressures of which are made to be adjustable, is connected to the refrigerating cycle. The unit test was performed under conditions that the discharge pressure of the closed-type compressor 10 was 15 kg/cm$^2$, the suction pressure was 0.5 kg/cm$^2$, the room temperature was set to 35° C. and the revolving speed of the motor 12 was 3600 rpm.

Referring to FIG. 3, a continuous line A represents an example of the closed-type compressor 10 according to the present invention and arranged such that the sliding portions of the reciprocating-type compressing machine 12 were subjected to the manganese phosphate film forming treatment to form the insoluble film. A dashed line B represents a closed-type compressor having no insoluble film formed thereon. Both of the closed-type compressors are arranged such that the cylinder is disposed in an offset manner. The cylinder offset position will be described later.

Figure 4:
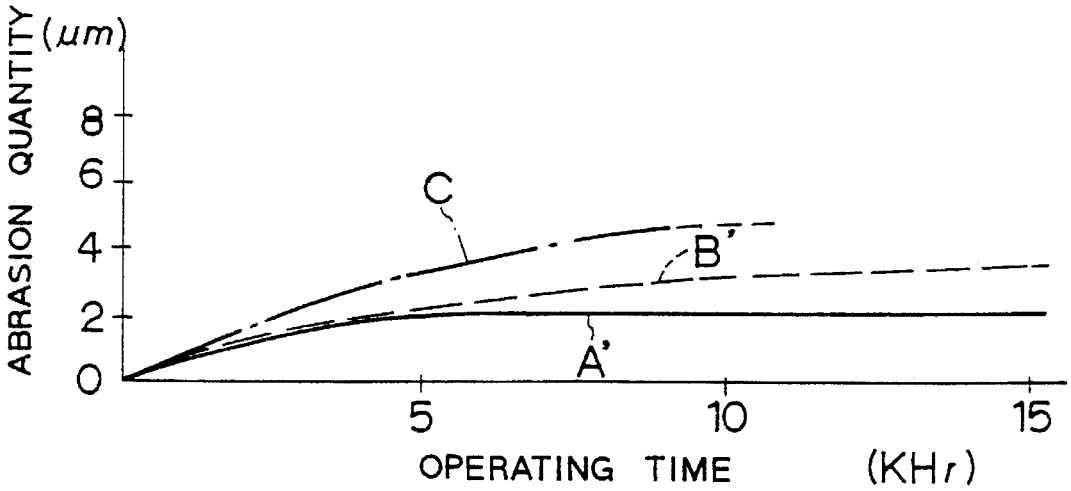
FIG. 4 is a graph showing change with time in the quantity of wear of a sliding surface of a cylinder of the reciprocating-type compressing machine of the closed-type compressor of FIG. 1.

FIG. 4 shows the change in the quantity of abrasion of the cylinder sliding portion as the time passes in a product test in which the closed-type compressor 10 is employed in a refrigerator. The closed-type compressor 10 was operated under conditions that the room temperature was set to 35° C. and the revolving speed of the motor 12 was 3000 rpm.

Referring to FIG. 4, a continuous line A' represents the result in a case where the sliding portion of the reciprocating-type compressing machine 13 was subjected to the manganese phosphate film forming process to form the insoluble film and the cylinder 27 was set in the offset manner. A dashed line B' represents the results in a case where no film was formed and the cylinder was disposed in the offset manner, while a chain line C represents the results in a case where no film was formed and the cylinder was not disposed in the offset manner.

As can be understood from the results of the tests shown in FIGS. 3 and 4, the examples in which the spherical seat portion 29*a* and the cylinder sliding portions of the reciprocating-type compressing machine 13 are subjected to the manganese phosphate film forming treatment exhibited a reduced quantity of abrasion and the abrasion did not propagate. The quantity of abrasion of the spherical seat portion 29*a* shown in FIG. 3 is the change in the size in the direction of the depth of the sliding surface of the spherical seat portion 29*a*, while the quantity of abrasion of the cylinder sliding surface is the circularity of the cylinder after the compressor has been operated.

By effecting the manganese phosphate film forming treatment, the insoluble manganese phosphate film in the form of the porous crystal absorbs and maintains the lubricating oil 22 so as to assist the operation of lubricating the sliding surface. Furthermore, the manganese phosphate film eliminates appearance of the projections and pits in the surface finished by machining and the surface processed by the nitriding treatment so that the initial conformability can be improved. In addition, the presence of the manganese phosphate film prevents the metal contact in the sliding portion so that galling, abrasion and burning are prevented.

In order to further improve the effect of lubricating the sliding portions of the reciprocating-type compressing machine 13, a lubricating material such as the manganese phosphate film formed by chemical reactions and exemplified by molybdenum disulfide or graphite may be employed. The molybdenum disulfide or the graphite is applied by being sprayed onto the film such as the manganese phosphate film formed by chemical reactions, and then it is burnt. Each of the foregoing materials is able to lower the friction coefficient and lengthen the life of the film formed by chemical reactions.

The offset position of the cylinder will now be described.

The closed-type compressor 10 shown in FIG. 1 comprises the piston-cylinder assembly including the cylinder 27 disposed in the offset manner. The offset positioning of the cylinder 27 is made such that the axial line of the cylinder 27 passes through a position deviated from the axial line of the rotational shaft 19. The quantity (distance) E of offset of the cylinder 27 is the quantity (distance) of deviation from the axial line of the rotational shaft 19.

Figure 5:
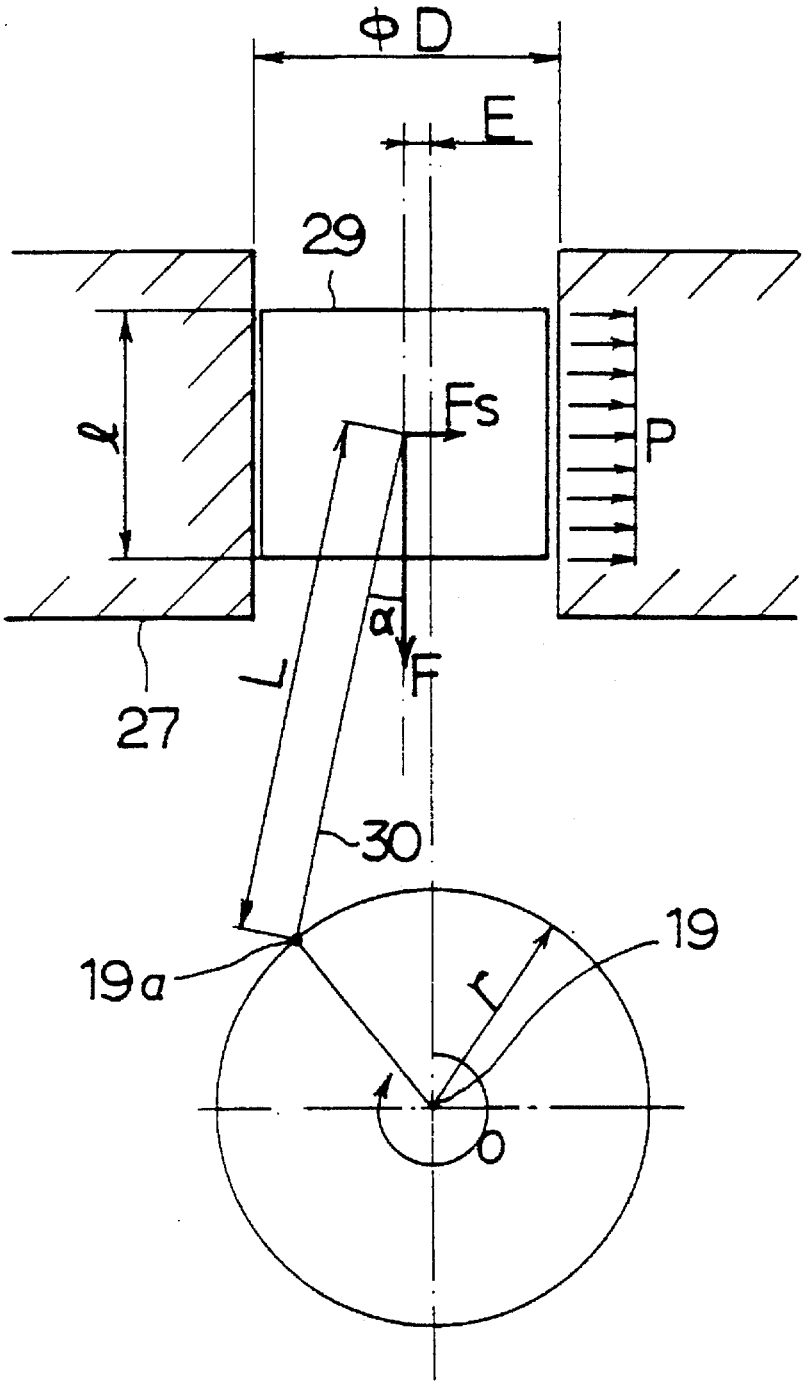
FIG. 5 is a diagram showing an example of offset position of the cylinder of the reciprocating-type compressing machine.

As shown in FIG. 5, the offset positioning of the cylinder 27 is able to reduce load Fs acting on the sliding surface between the piston and the cylinder when the closed-type compressor 10 compresses the refrigerant. The quantity E of the offset is radius r or less of the crank of the rotation shaft and the direction of the offset is set in a direction opposing the rotational direction of the rotation shaft.

The quantity E of the offset of the cylinder is set to, for example, 2 mm in a case where the crank radius r of the rotation shaft 19 is 6.1 mm and the length L of the connection rod 30 is 34.3 mm.

The relationship between pressure P acting on the sliding surface of the cylinder and the value of a multiplication (pressure)×(velocity), that is, (PV), is shown in Table 1 in a case where no offset is provided for the cylinder 27 (the axial line of the cylinder bore is made to pass through the axial line of the rotation shaft 19) and in a case where the quantity of the offset is set to 2 mm.

TABLE 1

| Quantity of Offset (mm) | 0 | 2 |
|---|---|---|
| Pmax (kgf/mm$^2$) | 2.6<br>(100) | −1.6<br>(62) |
| PV max<br>(kgf/mm$^2$· m/s) | 3.9<br>(100) | 1.7<br>(44) |

(values in parentheses are those when no offset is made to be 100)

As can be understood from the Table 1, the setting of the quantity E of the offset of the cylinder 27 to 2 mm is able to lower the pressure P acting on the sliding surface of the cylinder 27 by 38% and the value PV by 56%.

Assuming that the load realized by the gas pressure of the compressor refrigerant acting on the surface of the head (top) portion of the piston 29 is P, the load acting on the sliding portion between the piston and the cylinder is Fs and the surface pressure acting on the sliding portion of the cylinder is P when the piston 29 is reciprocated, the following equation is established.

$$Fs=F\cdot\tan\alpha$$

$$P=Fs/D\cdot l \qquad (1)$$

where D is the diameter of the cylinder bore, l is the axial length of the piston, α is an angel made by the connection rod and the axial line of the cylinder bore.

FIG. 4 shows the relationship between the quantity of abrasion of the sliding surface of the cylinder and the time in which the compressor is operated depending upon the provision or exclusion of the offset E of the cylinder 27 and the provision or exclusion of the manganese phosphate film forming treatment. As can be understood from FIG. 4, the offset positioning of the cylinder and the manganese phosphate film forming treatment applied to the sliding surface of the cylinder enable the quantity of abrasion to be reduced considerably and propagation of the wear to be prevented.

Therefore, the offset positioning of the cylinder 27 of the reciprocating-type compressing machine 13 and the manganese phosphate film forming treatment applied to the sliding portion of the reciprocating-type compressing machine 13 result in that the presence of the insoluble manganese phosphate film prevents the metal contact in the sliding portion. Thus, galling, wear and the like can effectively be prevented and therefore the smooth sliding is realized for a long time.

The embodiment of the present invention has been described about the case where the electric motor is accommodated in a lower portion of the closed casing and the reciprocating-type compressing machine is accommodated in the upper portion of the vertical type closed-type compressor. However, another arrangement may be employed in which the motor is accommodated in the upper portion and the reciprocating-type compressing machine is accommodated in the lower portion of the vertical closed-type compressor. The closed-type compressor may be a horizontal type or a high-pressure type compressor.

The closed-type compressor may be a rotary-type compressor, a helical-type compressor or a scroll-type compressor in place of the reciprocating-type compressor. The stator of the motor may be directly fixed in the closed casing by press fitting or shrinkage fitting. The compressing machine may be secured to the closed casing through the fixed frame.

As described above, the closed-type compressor according to the present invention uses the HFC refrigerant (the HFC refrigerant is solely used or a mixed type HFC refrigerant is used) as the compressor refrigerant. Therefore, the refrigerant involves substantially zero ozone destructive coefficient, thus being moderate for the earth environment. Furthermore, use of the refrigerator oil containing the ester-type oil as the lubricating oil results in the excellent heat resistance and the satisfactory compatibility with the HFC refrigerant.

Further, the cast iron of the manganese phosphate type and subject to the insoluble film forming process is employed to make one of the members constituting the sliding portion of the compressing machine and carbon steel is used to make the other member so that the insoluble lubricating film is formed on at least one of the members constituting the sliding portion to prevent metal contact. Therefore, wear and damage of the sliding portions can effectively be prevented, thus enabling the performance of the compressor to be maintained for a long time and the reliability to be improved.

Even if the HFC refrigerant containing no chlorine is used as the compressor refrigerant and the refrigerator oil containing the ester oil is used as the lubricating oil, the insoluble film forming process using the manganese phosphate or the like enables a lubricating film to be formed on the surfaces of the sliding portions. Therefore, burning, galling and wear can effectively be prevented so that the wear resistance and the damage resistance are improved.

The insoluble film formed on the sliding portions is able to eliminate projections and pits in the surface finished by machining. Thus, the initial conformability of the sliding members can be improved.

It is to be noted that the present invention is not limited to the described embodiment and many other changes or modifications may be made within the scope of the appended claims.

What is claimed is:

1. A closed-type compressor which comprises a closed casing accommodating an electric motor from which a rotational shaft extends and a compressing machine to be operated by the motor, the compressing machine being provided with a sliding portion, wherein a hydrofluorocarbon (HFC) refrigerant is used as a compressor refrigerant, wherein a refrigerator oil consisting essentially of ester is used as a lubricating oil and wherein the sliding portion of the compressing machine is formed of two members, one of which is made of cast iron subjected to an insoluble film forming process using manganese phosphate and another one of which is made of carbon steel.

2. A closed-type compressor according to claim 1, wherein said compressing machine is of a reciprocating-type provided with a piston-cylinder assembly and wherein said one of the members constituting the sliding portion is a cylinder member of the piston-cylinder assembly and said another one of the members constituting the sliding portion is a piston member of the piston-cylinder assembly.

3. A closed-type compressor according to claim 2, wherein said cylinder member is disposed in an offset manner such that an axial line of said cylinder member passes through a position deviated from an axial line of the rotational shaft of the motor transmitting a rotational torque from the motor.

4. A closed-type compressor according to claim 1, wherein said HFC refrigerant is a refrigerant of 1,1,1,2-tetrafluoroethane (refrigerant R134a).

5. A closed-type compressor according to claim 1, wherein said refrigerant oil is ester oil.

6. A closed-type compressor which comprises a closed casing accommodating an electric motor from which a rotational shaft extends and a compressing machine to be operated by said motor, said compressing machine being provided with sliding portions, wherein a hydrofluorocarbon (HFC) refrigerant is used as a compressor refrigerant, wherein a refrigerator oil consisting essentially of ester is used as a lubricating oil, and wherein each of the sliding portions of the compressing machine is formed of two members, one of which is made of cast iron subjected to a nitriding treatment and to an insoluble film forming treatment using manganese phosphate and another one of which is made of a carbon steel not subjected to any treatment.

7. A closed-type compressor according to claim 6, wherein said compressing machine is of a reciprocating-type compressing machine provided with a piston-cylinder assembly, wherein said one of the members constituting the sliding portion is a piston spherical seat member of the piston-cylinder assembly and wherein said another one of the members constituting the sliding portion is a ball portion at one end of a connection rod operatively connected to the rotational shaft, said ball portion at one end having a diameter smaller than that of another end portion of the connection rod.

8. A closed-type compressor according to claim 7, wherein a cylinder member of the piston-cylinder assembly is disposed in an offset manner such that an axial line of said cylinder passes through a position deviated from an axial line of the rotational shaft of the motor transmitting a rotational torque from the motor.

9. A closed-type compressor according to claim 6, wherein said HFC refrigerant is a refrigerant of 1,1,1,2-tetrafluoroethane (refrigerant R134a).

10. A closed-type compressor according to claim 6, wherein said refrigerant oil is ester oil.

11. A closed-type compressor which comprises a closed casing accommodating an electric motor from which a rotational shaft extends and a compressing machine to be operated by the motor, the compressing machine being provided with a sliding portion, wherein a hydrofluorocarbon (HFC) refrigerant is used as a compressor refrigerant, wherein a refrigerator oil consisting essentially of ester is used as a lubricating oil and wherein said compressing machine is of a reciprocating-type provided with a piston-cylinder assembly in which the sliding portion of the compressing machine is formed of two members, one of which is a cylinder member of the piston-cylinder assembly made of cast iron subjected to an insoluble film forming treatment using manganese phosphate and another one of which is a piston member of the piston-cylinder assembly made of carbon steel, said piston member including a piston spherical seat portion subjected to a nitriding treatment and then subjected to an insoluble film forming treatment using manganese phosphate, said piston spherical seat portion being engaged with a connection rod operatively connected to the rotational shaft, said connection rod having one end which is of a diameter smaller than another end thereof and made of a carbon steel not subjected to any treatment.

12. A closed-type compressor according to claim 11, wherein the cylinder member of the piston-cylinder assembly is disposed in an offset manner such that an axial line of said cylinder passes through a position deviated from an axial line of the rotational shaft of the motor transmitting a rotational torque from the motor.

13. A closed-type compressor according to claim 11, wherein said HFC refrigerant is a refrigerant of 1,1,1,2-tetrafluoroethane (refrigerant R134a).

14. A closed-type compressor according to claim 11, wherein said refrigerant oil is ester oil.

* * * * *